US007257932B2

(12) United States Patent
Ng

(10) Patent No.: US 7,257,932 B2
(45) **Date of Patent: *Aug. 21, 2007**

(54) LIGHT WEIGHT BUILDING MATERIAL

(76) Inventor: Hong Liang Ng, Lot 5781 & 5782, Tamen Sclamat, Alma, 14000 Bukit Mertajam, Seberang, Perai Tengah (MY)

( * ) Notice: Subject to any disclaimer, the term of this patent is extended or adjusted under 35 U.S.C. 154(b) by 0 days.

This patent is subject to a terminal disclaimer.

(21) Appl. No.: 09/799,330

(22) Filed: Mar. 5, 2001

(65) Prior Publication Data

US 2002/0121068 A1 Sep. 5, 2002

(51) Int. Cl.
*E04C 3/04* (2006.01)

(52) U.S. Cl. ..... 52/634; 52/650.1; 52/731.3; 52/732.2; 29/897.31; 29/897.35; 138/168; 138/173

(58) Field of Classification Search ..... 52/731.2, 52/731.3, 731.4, 737.6, 732.1, 732.2, 729.3, 52/729.5, 730.6, 634, 730.4, 730.5, 650.1, 52/786.13; 138/168, 173; 29/897.31, 897.35; D23/266; D25/126
See application file for complete search history.

(56) References Cited

U.S. PATENT DOCUMENTS

| | | | | | |
|---|---|---|---|---|---|
| 16,877 | A | * | 3/1857 | Griggs | 15/178 |
| D7,463 | S | * | 6/1874 | Starr | D8/313 |
| 1,090,171 | A | * | 3/1914 | Schisler | 52/731.2 |
| 1,268,745 | A | * | 6/1918 | Martin | 138/163 |
| 1,552,474 | A | * | 9/1925 | Dornier | 52/634 |
| 1,656,810 | A | * | 1/1928 | Arnstein | 52/634 |
| 1,739,233 | A | * | 12/1929 | Huenefeld | 138/168 |
| 1,890,077 | A | * | 12/1932 | Elting | 72/368 |
| 1,891,740 | A | * | 12/1932 | Westerman | 138/165 |
| 1,997,876 | A | * | 4/1935 | Sheldon | 52/731.2 |
| 2,039,886 | A | * | 5/1936 | Cohn | 285/330 |
| 2,259,382 | A | * | 10/1941 | Ingels | 403/326 |
| 2,684,266 | A | * | 4/1954 | Englehart | 52/172 |
| 2,845,889 | A | * | 8/1958 | Jones | 72/51 |
| 2,975,874 | A | * | 3/1961 | Pagan | 138/163 |
| 3,151,767 | A | * | 10/1964 | Nakata | 220/689 |
| 3,208,140 | A | * | 9/1965 | Mayrath | 29/505 |
| 3,224,154 | A | * | 12/1965 | Toti et al. | 52/520 |
| 3,282,005 | A | * | 11/1966 | Birdwell | 52/364 |
| 3,448,775 | A | * | 6/1969 | Foglia et al. | 138/173 |
| 4,713,924 | A | * | 12/1987 | Toti | 52/731.3 |
| 4,987,717 | A | * | 1/1991 | Dameron, Jr. | 52/11 |
| 5,074,138 | A | * | 12/1991 | Miller | 72/49 |
| 5,379,567 | A | * | 1/1995 | Vahey | 52/724.5 |
| 5,417,028 | A | * | 5/1995 | Meyer | 52/737.6 |
| D361,631 | S | * | 8/1995 | King | D25/128 |
| 5,778,626 | A | * | 7/1998 | Hellsten | 52/731.2 |
| 6,014,988 | A | * | 1/2000 | Gagnon et al. | 138/168 |
| 6,094,881 | A | * | 8/2000 | Lockwood | 29/897.33 |
| D447,545 | S | * | 9/2001 | Ng | D23/266 |
| 6,296,287 | B1 | * | 10/2001 | Kinbara et al. | 293/120 |
| 6,415,576 | B1 | * | 7/2002 | Stromback | 52/719 |
| 6,802,170 | B2 | * | 10/2004 | Davis | 52/731.2 |
| 2003/0126827 | A1 | * | 7/2003 | Davis | 52/731.2 |

FOREIGN PATENT DOCUMENTS

| | | | |
|---|---|---|---|
| GB | 629078 | * | 9/1949 |

* cited by examiner

*Primary Examiner*—Robert Canfield
(74) *Attorney, Agent, or Firm*—Hamre, Schumann, Mueller & Larson, P.C.

(57) ABSTRACT

The present invention relates to a light weight building material (1) for structural work. The light weight building material (1) comprises at least three walls, a first wall (11), a second wall (12) and a third wall (13) formed from a single piece of galvanized iron sheet to form a triangular-section. However, a circular section may also be used while a rectangular section is preferred. The galvanized iron sheet is cut and cold-rolled to form the light weight building material (1).

6 Claims, 1 Drawing Sheet

LIGHT WEIGHT BUILDING MATERIAL

1.0 TECHNICAL FIELD OF THE INVENTION

The present invention generally relates to a building material, especially to a light weight building material for use in structural work.

2.0 BACKGROUND OF THE INVENTION

With our forest fast diminishing, timber supply is getting scarce and inconsistent in grade. This makes the cost of timber as a building material prohibitively high. Over the years, building contractors and developers have been forced to look for alternative materials to reduce the cost of building construction. Many approaches have been proposed in the past to utilize light weight building material made from metal for structural works such as roof trusses or the likes, however until the present invention, the results have not been very encouraging. In many prior art practices, the truss members are formed from a U-shape section of a metal sheet. In one example, the ends of the legs of the U-section are tightly folded back to form a thick double edge. The top chords in prior art practices are formed of inverted U-shaped sections having flanges projecting One of the major difficulties with many of the prior art practices to manufacturing of metal roof trusses is that different components are used for bottom chords and the top chords resulting in two different fabrication lines or at least two different set ups for fabrication lines are required. Furthermore, two different stock items must be maintained in inventory. In addition, because of the flanges of the top chord members, it is necessary to provide for cutting the flanges off at least one of the top chords at the apex of the truss.

Due to the unfriendly U-shaped of the building material, handling and working with the building material is rather difficult adding unnecessary cost to the construction. Strength and rigidity of the building material are also suspect. The present invention attempts to solve at least partially if not completely these problems.

3.0 SUMMARY OF THE INVENTION

Accordingly, it is the primary object of the present invention to provide a light weight building material for use in structural work.

It is another object of the present invention to provide a light weight building material for use in structural work that has a considerable strength and rigidity.

It is yet another object of the present invention to provide a light weight building material for use in structural work that is rust proof for long life.

These and other objects of the present invention are accomplished by

A light weight building material (1) having a wall section (11) characterized by said wall section (11) being in a piece of metal sheet forming an endless wall.

4. BRIEF DESCRIPTION OF THE DRAWINGS

The present invention may be better understood from reading of the following Detailed Description taken in conjunction with the accompanying drawings in which.

5. DETAILED DESCRIPTION OF THE DRAWINGS

Figure 1:
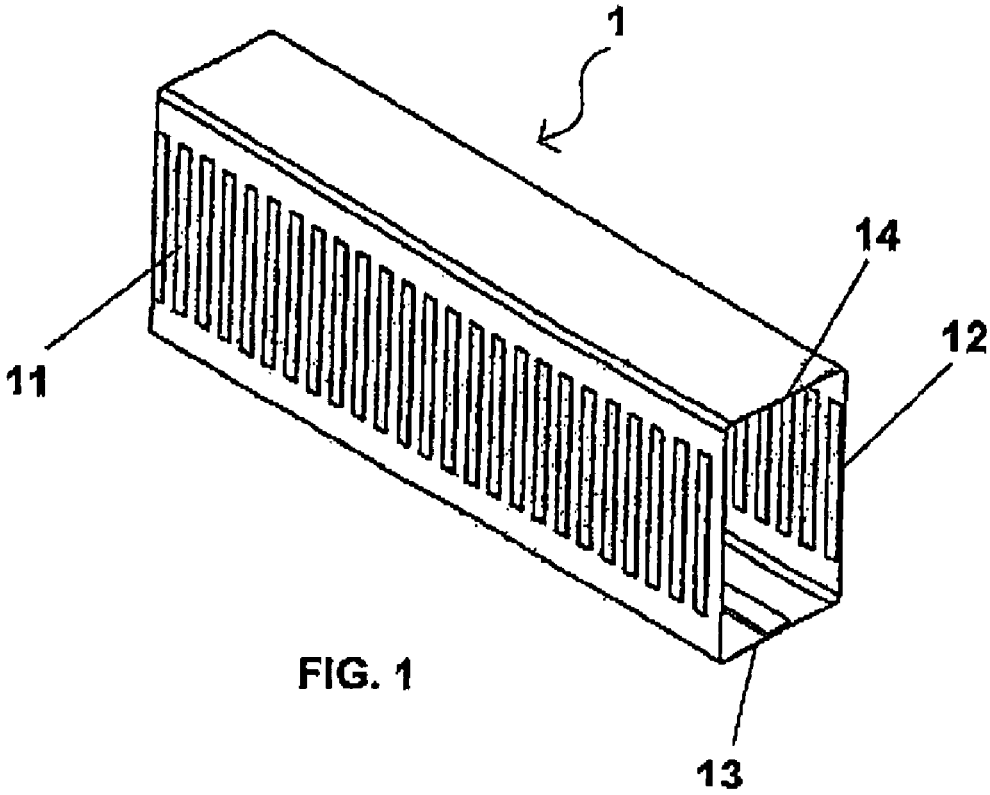
FIG. 1 illustrates a light weight building material according to one embodiment of the present invention.
Figure 2:
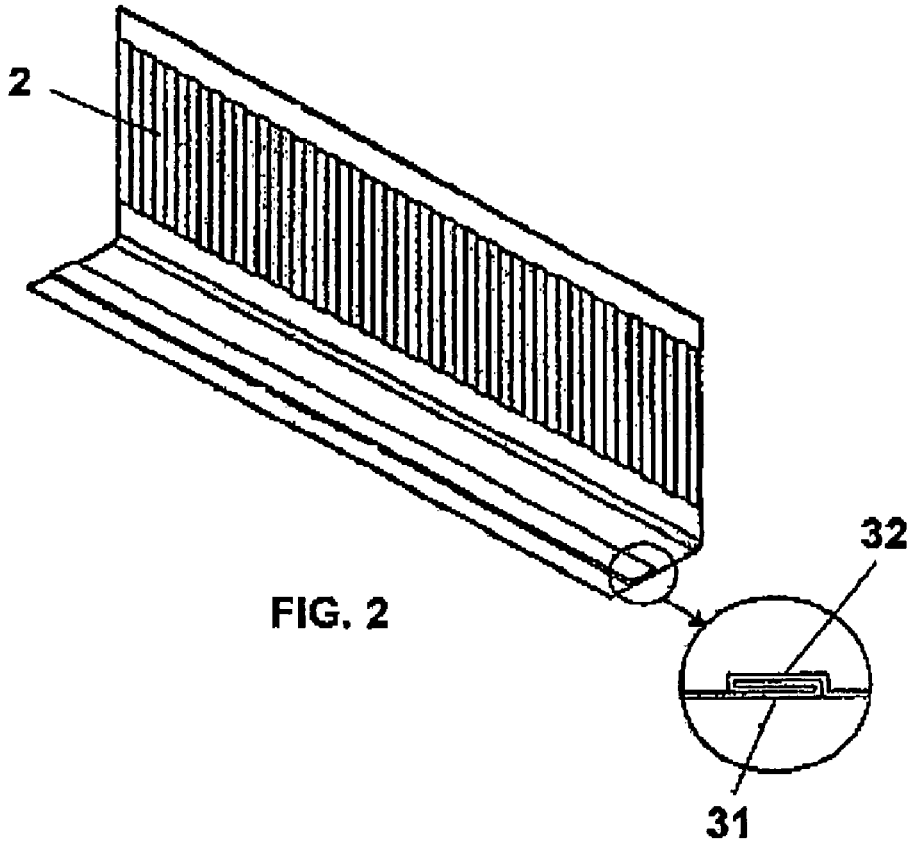
FIG. 2 illustrates a cross-sectional view of the light weight building material.

Referring now to FIG. 1 which illustrates a light weight building material according to one embodiment of the present invention and FIG. 2 which illustrates a cross-section view of the light weight building material. A rectangular-section of the light weight building material (1) having four walls, a first wall (11), and a second wall (12), a third wall (13) and a fourth wall (14) is preferred. Alternatively, a round or triangular section may also be used. The close section will eliminate the necessity to fold back to form the double edge for strength and rigidity of the prior art practice.

The light weight building material (1) is formed from a single piece of metal sheet, advantageously a galvanised mild steel sheet. The metal sheet is cut to size and rolled-formed to form the light weight building material (1). This is a simple single run machining.

To form the light weight building material (1), the metal sheet is first being provided with a first interlocking means (31) on one end and a second interlocking means (32) on the other end. As the metal sheet is rolled over the roll-forming machine, the first interlocking means (31) will mate the second interlocking means (32) to thereby formed the light weight building material (1). To further strengthen the joint, rivets may be applied along the mating line of the interlocking means.

To further strengthen the light weight building material, the first and second walls (11, 12) are provided with a reinforcing means (2). The reinforcing means (2) may be a plurality of ribs or corrugations formed on the walls (11, 12)

It will be understood by those skilled in the art that changes and modifications may be made to the invention without departing from the spirit and scope of the invention. Therefore it is intended that the foregoing description is merely for illustrative purposes and not intended to limit the spirit and scope of the invention in any way.

What is claimed is:

1. A light weight building material having a length, a width, and a height, the building material comprising:

first and second side sections, a top section, and a bottom section, the sections being formed as a rectangular single elongated metal sheet, the first and second side sections extending longitudinally along the length of the building material and laterally along the height of the building material, the first and second side sections being generally parallel to the other, and the first and second side sections including a plurality of corrugations extending in a direction traverse to the length of the building material, the plurality of corrugations disposed on only the first and second side sections, the top section extending longitudinally along the length of the building material and laterally along the width of the building material, the bottom section defining a first and second bottom portion extending longitudinally along the length of the building material, the first bottom portion having a width substantially equal to a width of the second bottom portion, and the bottom section having a rolled interlocking joint including at least four layers extending longitudinally along the length of the building material, the rolled interlocking joint including a first generally U-shaped portion formed from the first bottom portion and a second generally U-shaped portion formed from the second bottom portion, each U-shaped portion forming two of the four layers of the rolled interlocking joint, each U-shaped portion being configured to interlock with the other, and each U-shaped portion having a major surface extending laterally along the width of the building material, and the major surface of each U-shaped portion having a lateral width that is at least two times greater than a thickness of the interlocking joint in a direction perpendicular to the lateral width.

2. The building material of claim 1 wherein the metal sheet is galvanized mild steel.

3. The building material of claim 1, wherein the building material is a roof truss.

4. The light weight building material of claim 1, wherein the thickness of the interlocking joint substantially is disposed so as to face inward and away from an outer surface of the bottom section, and the generally U-shaved portions abut each other when interlocked, such that the outer surface of the bottom section being substantially planar at the interlocking joint.

5. A roof truss having a major axis, comprising:

a single elongated metal sheet forming a closed hollow section in a plane perpendicular to the major axis, the closed hollow section defining a rectangular-section having two side walls, a top wall and a bottom wall;

means for interlocking opposite edges of the metal sheet, the interlocking means being disposed at the opposite edges of the metal sheet on the bottom wall, the interlocking means having a thickness that is substantially disposed so as to face inward into the hollow section and away from an outer surface of the bottom section, such that the outer surface of the bottom section is substantially planar at the interlocking means; and means for reinforcing the roof truss, the reinforcing means being disposed on only the two side walls wherein the reinforcing means being either a plurality of corrugations or a plurality of ribs, the corrugations or ribs each extending in a direction substantially perpendicular to the major axis of the roof truss.

6. A roof truss as claimed in claim 5, wherein the metal sheet is a galvanized steel or iron sheet.

* * * * *